US005397182A

United States Patent [19]

Gaible et al.

[11] Patent Number: 5,397,182

[45] Date of Patent: Mar. 14, 1995

[54] WRITE-ON PROFILE STRIPS FOR RECLOSEABLE PLASTIC STORAGE BAGS

[75] Inventors: Susan C. Gaible, Rockville, Va.; Catherine E. Kettner; Mladomir Tomic, both of Appleton, Wis.

[73] Assignee: Reynolds Consumer Products Inc., Appleton, Wis.

[21] Appl. No.: 136,747

[22] Filed: Oct. 13, 1993

[51] Int. Cl.[6] ..... B65D 33/24

[52] U.S. Cl. ..... 383/63

[58] Field of Search ..... 383/63, 65

[56] References Cited

U.S. PATENT DOCUMENTS

| | | | |
|---|---|---|---|
| 3,226,787 | 1/1966 | Ausnit | 383/65 X |
| 4,186,786 | 2/1980 | Kirkpatrick | 383/63 |
| 4,212,337 | 7/1980 | Kamp | 383/63 |
| 4,285,105 | 8/1981 | Kirkpatrick | 383/63 |
| 4,363,345 | 12/1982 | Schelbner | 383/63 |
| 4,528,224 | 7/1985 | Ausnit | 428/36 |
| 4,547,445 | 10/1985 | Asahina et al. | 430/269 X |
| 4,578,813 | 3/1986 | Ausnit | 383/63 X |
| 4,701,358 | 10/1987 | Behr et al. | 428/35 |
| 4,736,451 | 4/1988 | Ausnit | 383/65 |
| 5,038,547 | 8/1991 | Kai et al. | 383/200 X |
| 5,092,684 | 3/1992 | Weeks | 383/65 X |
| 5,152,613 | 10/1992 | Herrington, Jr. | 383/63 |
| 5,248,201 | 9/1993 | Kettner et al. | 383/63 |
| 5,308,666 | 5/1994 | Borchardt | 383/116 |

FOREIGN PATENT DOCUMENTS 089680 9/1983 European Pat. Off. .

*Primary Examiner*—Stephen P. Garbe

*Attorney, Agent, or Firm*—Alan T. McDonald

[57] ABSTRACT

A recloseable container features webs or flanges near the container opening and outwardly from recloseable locking strips, coextensive with the opening, to provide improved roughened surfaces enabling the user to write on these webs information pertaining to the bag contents. The webs may be formed with a roughening agent to create the roughened surfaces. The locking projections of at least one of the closure elements is formed with a slip agent to facilitate lubricated mating engagement with the other locking projection.

5 Claims, 2 Drawing Sheets

WRITE-ON PROFILE STRIPS FOR RECLOSEABLE PLASTIC STORAGE BAGS

TECHNICAL FIELD

The present invention relates generally to recloseable plastic storage bags and, more particularly, to recloseable plastic bags formed with extruded plastic side walls with a profile strip or web, along an open end of the bag, for receiving printed information for identifying bag contents and related information.

BACKGROUND ART

Various types of plastic container bags utilize a pair of closure strips respectively having male and female members which interlock together to close an open end of the container bags to seal its interior from the external environment. The strips and associated container side walls are typically each formed from thermoplastic material. The container side walls are usually formed by extrusion. A sheet of extruded material is folded, forming two walls, or the two walls are constructed as two separate panels which are then heat-sealed together along two or three edges to define the container and an open end along one side thereof. The closure strips are also usually formed by extrusion and then connected to the side walls of the container along the open end by heat-sealing or other suitable means to define what is known as a recloseable profile. The closure strips and container body may also possibly be formed as a single piece by extrusion.

Each closure strip is preferably coextruded with a web member which is heat-sealed or otherwise secured to one of the side walls of the container body. More specifically, with reference to FIG. 1, a first of these webs 10 has an extruded layer formed with an upper web portion 12 and a lower web portion 14 extending coextensive with a first closure strip 16 thereon. This closure strip 16 contains first locking members 18 projecting inwardly from an inner surface of the first web 10, between the upper and lower web portions 12,14, to matingly engage second locking members 20 defining a second closure strip 22 which is coextruded with a second web 24 also having an upper web portion 26 and a lower web portion 28. The first and second locking members 18,20 are either male or female, respectively, to mate with each other. The lower web portions 14,28 are heat-sealed to the upper edge of respective ones of the plastic side walls (not shown in detail) as is known. The upper web portions 12,26 project upwardly from their associated closure strips 16,22 to respectively define what are commonly known as a top or a consumer side web located between the recloseable profile and the open end of the container. Typically, these webs 12,26, also known as flanges, are formed to allow for finger gripping to enable the consumer to grasp both side walls and enable separation of the side walls by pulling them away from each other to facilitate unlocking of the recloseable profile.

Since the first and second aforementioned webs 10,24 are each preferably extruded to contain the locking members 18,20, it is conventional practice to blend what is known as a slip agent into the extrusion material. These slip agents are primary amides or other materials known as slip agents in film extrusion which tend to migrate onto the profile surface over time to lubricate the locking members 18,20 and thereby to facilitate repeated locking and unlocking of these members during consumer usage. This slip agent is important to enable the male and female locking members 18,20 to deflect past each other during locking/unlocking. However, as a result of this slip agent being incorporated into the extrudate, the primary amides will also migrate or 'bloom' onto the surfaces of the upper as well as the lower gripping webs 12,26 and 14,28. This prevents consumers from being able to write on these upper webs with a ballpoint pen to label or identify the package contents since the pen ink does not readily adhere to the slippery surfaces of the webs created by this slip agent.

It is accordingly one object of the present invention to enable a consumer to write on the upper web or consumer side web of a recloseable profile with a writing instrument to label or identify the package contents.

Another object is to allow the consumer to write on the upper web with a ballpoint pen.

Still another object is to enable the consumer to write on either the inside surface or the outside surface of each upper web and package side webs 14,28.

Yet a further object is to create a roughened writing surface in the upper webs, on the inside and/or outside surfaces, while allowing a slip agent to be added to vital areas in the locking members of the closure strips to aid in the ease of reclosing of the profile.

Yet a further object is to provide a roughened writing surface in the upper webs through the addition of an anti-slip agent which is uniformly mixed into the extrusion material which avoids the need for separate reservoirs and transfer channels and slot combining regions in a closure profile melt feed reservoir of a melt extrusion die apparatus.

DISCLOSURE OF THE INVENTION

The present invention concerns a container having a recloseable open end, comprising respective first and second side walls, including a closure fastening device having first and second closure profiles extending on said respective side walls coextensive with the open end. The first and second closure profiles are operable for being occluded and disengaged with respect to each other to close and open the end. Each of the first and second closure profiles has a grasping area near the open end. The improvement according to this invention comprises at least one of the grasping areas or flanges being formed with a roughened surface to define a write-on surface enabling the consumer to label or identify the container contents.

The closure profiles are preferably each attached to the respective side walls, such as by heat-sealing.

In accordance with a further feature of the invention in the preferred embodiment, portions of at least one of the first and second closure profiles directly engageable with the other of said profiles is formed with a slip agent which lubricates surfaces of these engageable portions. In this manner, the slip or lubricating agent can be provided in areas of the profiles requiring lubrication or slipperiness while surfaces of the grasping area formed adjacent the engageable portions may have opposite characteristics, i.e., a roughened and preferably non-slippery surface amenable to receiving ballpoint pen ink or other types of hand-written indicia medium.

The slip agent is preferably a primary amide of a type which blooms or migrates to the surface of the engageable portions. The roughened surface(s) is preferably formed from a particulate material which is uniformly mixed in an extrusion material forming the grasping and sealing webs.

The engageable portions containing the slip agent are preferably formed as a second layer coextruded with the first extruded layer.

The particulate material for the first layer is preferably selected from the group consisting of diatomite, silica, talc, mineral and nonmineral antiblock agents, and mixtures thereof. Moreover, a gauge of the material forming the grasping area is at least preferably 3.5 mil.

In accordance with a further feature of this invention, a process for making a container having a recloseable end is also disclosed, wherein the container is further formed with respective first and second side walls, and a closure fastening device including first and second closure profiles positioned on the respective side walls and operable for being occluded and disengaged with respect to each other to close and open the container. Each of the side walls has a grasping area near the end edge thereof. The improvement comprises extruding at least one grasping area with an extrusion material forming a roughened writing surface for receiving ballpoint pen ink and the like.

In accordance with a further aspect of the method, portions of at least one of the first and second closure profiles, which portions are adapted to directly engage the other of said profiles, are preferably coextruded with a second extrusion material containing a slip agent. The slip agent is preferably a primary amide capable of migrating or blooming to the surface of the engageable portions to provide lubrication to the engagement surfaces of these engageable portions which must deflect upon contact with the other closure profile to allow occlusion to occur.

In accordance with a preferred embodiment, a container of this invention comprises a pair of side walls for defining a container interior and at least one open end. The container further comprises a closure device including a first closure element and a second closure element each formed with a web respectively extending along said side walls adjacent the open end. The first and second elements are mateable so that, upon mating engagement of the first and second closure elements along their substantially entire respective lengths, said open end is substantially entirely closed, and wherein at least one of the first and second closure elements is colored a certain color so that upon substantially entirely complete mating of the first and second closure elements, the certain color is visually observable through an opposing one of the webs as a continuous band of said certain color. The web carrying the first or second closure element of said certain color is opaque to provide contrast with said certain color when the first and second closure elements are viewed through the opposing web. Portions of at least one of the first and second closure elements directly entering into mating engagement with the other of said elements are formed with a slip agent to lubricate the surfaces thereof. Material forming at least one of the webs is formed with a material which provides a roughened web surface receiving ballpoint pen ink and the like to enable the consumer to identify the container contents.

Preferably, only tip portions of one of the first and second closure elements is colored the certain color and remaining portions of said one of the first or second closure elements connecting the tip portions to the associated web are also opaque. The tip portions of the other of said first and second closure elements are also preferably opaque to provide contrast with the tip portions of said certain color.

Preferably, portions of the other of the first or second closure elements connecting the tips to the said opposing web are made of a transparent or clear resin coextruded with said tip portions.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1:
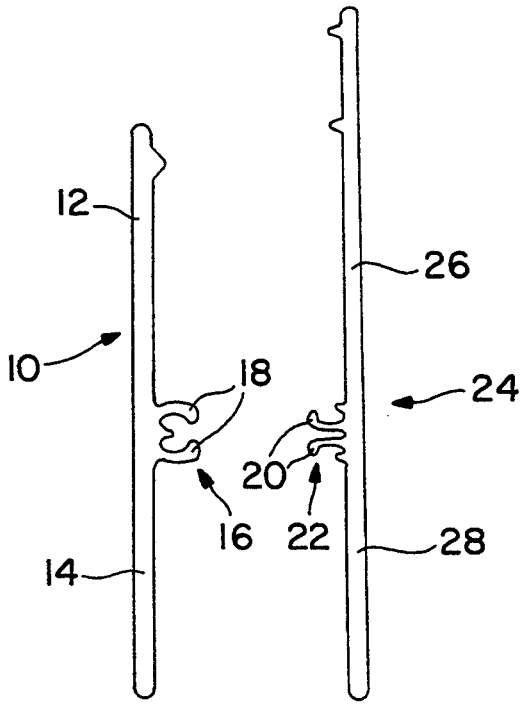
FIG. 1 is an illustration of first and second closure profile strips to which the present invention pertains.
Figure 2:
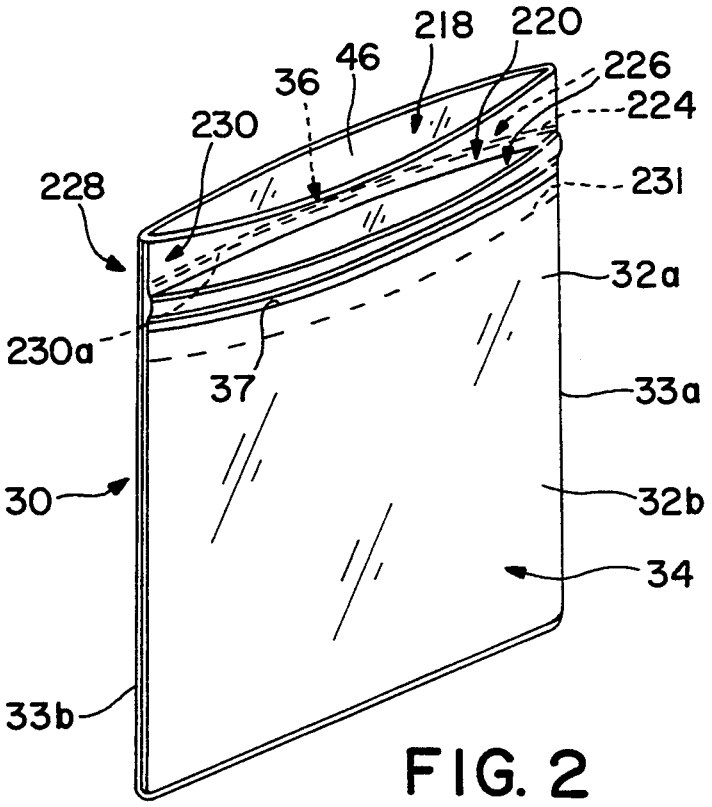
FIG. 2 is an illustration of a transparent flexible bag formed with a pair of interlockable first and second closure strips to which the present invention is applied.

FIG. 2 is an illustration of a container such as a clear flexible bag 30 formed with a pair of plastic side walls 32*a* and 32*b* which may be heat-sealed together along their edges 33*a*,33*b* to define a container interior 34 having an open end 36. The open end 36 is defined by upper edge portions 37 of the side walls 32*a*,32*b* extending between the heat-sealed edges 33*a*,33*b*. An interlocking closure device includes first and second closure elements or strips 218 and 220, respectively, in the form of a web, generally designated with reference numeral 228,230, respectively, from which projects an arrangement of locking members 226 mateable with other locking members 224 on the other web defining the opposite side of the interlocking closure device. The webs 228,230 have lower web portions 231 which are respectively heat-sealed to the inside surface of one of the upper edge portions 37 of the side walls 32*a*,32*b* and are preferably coextruded with their associated locking members 224,226. In accordance with the unique features discussed more fully below, the extrusion material forming each web 228,230 is made without a slip agent and is preferably mixed with an anti-slip agent to create a roughened writing surface on at least the upper web portion of at least one of the webs, while the tips of the locking projections which are adapted to enter into deflecting mating engagement with the other locking members are formed with a slip agent to facilitate such mating engagement.

Figure 4:
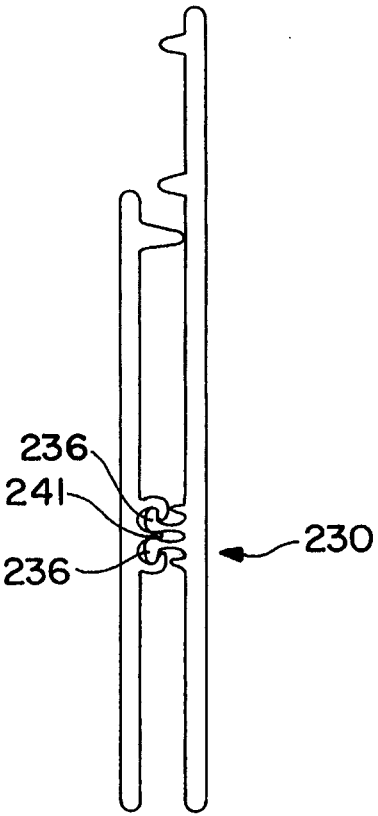
FIG. 4 is a view similar to FIG. 3 of the first and second closure elements in an interlocked condition.
Figure 3:
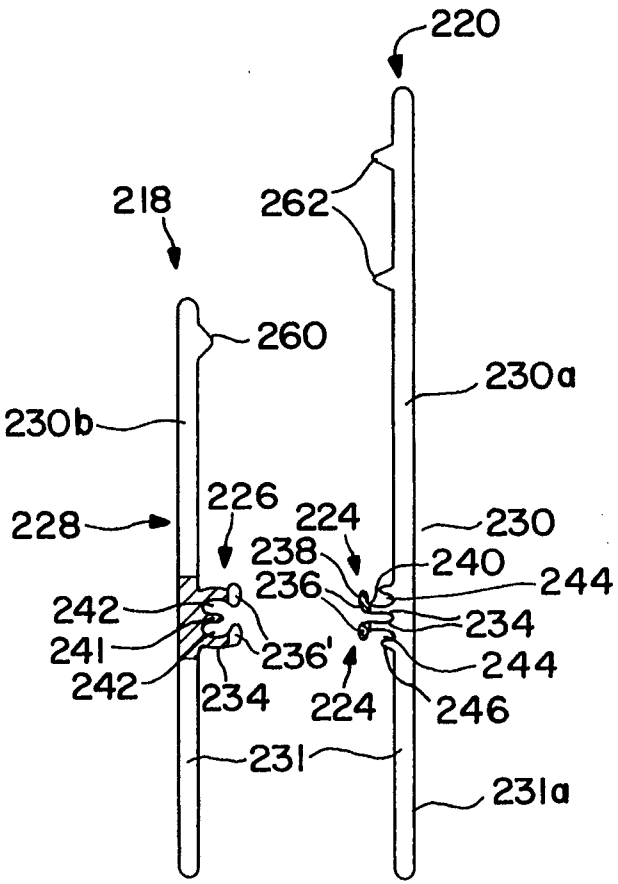
FIG. 3 is a sectional view of the first and second closure elements of the present invention in an unlocked condition.

FIGS. 3 and 4 are sectional views of a preferred embodiment of the instant invention wherein the mateable first and second closure strips 218 and 220 depicted in FIG. 2 are depicted in unlocking and in locking position, respectively. The second closure element 220 includes a pair of hook-like projections 224 projecting from an opaque, preferably white web 230 in spaced parallel relationship to each other. Each hook-like projection 224 is formed with a rib 234 of stem or stalk-like configuration extending generally perpendicular to the web 230 and having a hook-like distal end 236 or tip extending approximately perpendicular to its stem 234. The outermost surface 238 of each tip 236 which faces away from the associated web 230 is generally defined by a convex curve and an inner surface 240 of the tip which faces the web 230 is either straight or slightly concave although it may be convex as well.

The web 230 is formed with an upper web portion 230*a* and a lower web portion 231 whose outer surface 231*a* is adapted to be heat-sealed to the inner surface of the associated bag side wall 32*a*. In the preferred embodiment, the web 230 and the ribs 234 are formed with the same extrusion material having the same composition as discussed below. Advantageously, this extrusion material is formed without a slip agent and is instead formed with an agent which creates a toughened inner and outer surface on each web portion 230*a*,231. These roughened portions define write-on surfaces whereby the consumer may use a ballpoint pen or the like preferably on the upper web 230*a* inside or outside surface to label or identify the package contents.

In accordance with a further unique feature of the invention, the tips 236 are formed of a coextruded material which contains a slip agent as is discussed more fully below. In this manner, the slip agent in the tips 236 will migrate onto the tip surfaces 238,240 over time to lubricate the tips to facilitate locking and unlocking mating engagement with the hook-like projections 226 on the opposite closure element 218 to enable the desired deflection to occur. Advantageously, as will be seen below, these opposite hook-like projections 226 need not necessarily be formed with a slip agent.

The first closure element 218, as discussed briefly above, is also formed with a pair of hook-like projections, generally designated with reference numeral 226, extending from its associated continuous web 228. These hook-like projections 226 are also formed with a stem-like rib 234 and a hook tip 236' that may be identical in construction to the hook-like projections 224 except that the stems 234 of the hook-like projections 226 of the first closure element 218 are spaced further apart from each other than the stems on the second closure elements 224 to define, in cooperation with a wall or partition 241 extending parallel to and between the first members 226, a pair of locking channels or cavities 242. The hook-like projections 224 of the second closure element 220 are adapted to enter into the locking cavities 242 by virtue by resiliently yielding bias or deflection of the tips 236,236' of the first and second hook-like projections 224,226 as the continuous webs 228,230 are brought together under manual finger pressure during closure of the bag 10. As depicted in FIG. 3, full mating engagement of the second and first closure elements 224,226 results in sealing contact between portions of the outermost surface 238 of the tips of the second members with wall 241 of the locking cavity 242 and corresponding sealing contact between the outermost surfaces of the tips of the second members 226 with the corresponding locking cavity 244 formed between the hook-like projections 224 and associated walls 246 formed outwardly and parallel to the hook-like projections.

As mentioned above, the interlocking extremities or tips 236,236' of the second and first closure elements 224 and 226 are guided into interlocking engagement within the respective locking cavities 242,244 in response to a compressive force placed on the elements 218,220 as in the clamping together of the continuous webs 228,230 under manual finger pressure. In the preferred embodiment, the tips 236 of each of the two second elements 224 are colored a first color, such as blue (represented in black ink in FIG. 3), and the stalks 234 of each element 224 is colored a second color, preferably opaque, such as white, which is preferably the same color as the associated webs 230*a*,231. Thereby, on the second closure element 220, the same extrusion material is used to form both the webs 230*a*,231 and the locking projections 224 with the exception of the tips 236 which are formed with a different color and preferably with a different extrusion material in the manner described above. That is, the tips 236 are preferably formed with an extrusion material containing a slip agent while the main layer forming the webs, etc., of the second closure element is formed with a different coextruded material which does not contain a slip agent but instead, advantageously, preferably contains an agent providing the roughened writing surfaces as discussed hereinabove.

In the first closure element 218, the tips 236' of the hook-like projections 226, the partition wall 241 and the upper and lower web portions 230*b*,231, except those portions and stalks 234 identified with cross-hatching in FIG. 3, are preferably formed from the same type of extrusion material which forms the webs 230*a*,231, associated walls 246 and the stalks 234 of the second closure element 220. That is, a material which preferably does not include a slip agent but instead includes a roughening agent as discussed below. However, the stalks 234' of the hook-like projections 226 and the web portions respectively supporting the hook-like projections 226 as mentioned above are preferably transparent or clear (cross-hatching) in such a manner so that the first color of the second element tips 236 is visually observable as the first color as continuous bands of that color through the transparent web portions. This color (e.g., bright blue) and therefore the resulting continuous parallel bands are highly contrasted by the second color (preferably white) of the first element tips and webs so that in the event incomplete mating occurs over various lengths of the first and second closure elements 218,220, such incomplete closure would cause the continuous parallel bands of blue color to become wavy or non-parallel indicating areas of incomplete seals.

With the exception of the tips 236, preferably blue or other bright color, and with the exception of the clear transparent web and stalk portions on the first closure strip 218, the following blend of materials is preferred as a raw extrusion material which may be introduced into a closure profile melt feed reservoir of known construction and extruded through a closure shaped flow channel, also of known construction, to form a main layer in each closure strip 218,220 wherein the roughening agent is thoroughly mixed in the raw material:

| MATERIAL | % | MI | DEN | TYPE |
|---|---|---|---|---|
| Main Layer | | | | |
| Westlake 412AA | 80 | 2.0 | .922 | LD |
| Exxon 722.62 | 10 | 2.0 | .95 | EVA |
| Quantum 80707 | 5 | — | — | White Color |
| Quantum 19002 | 5 | — | — | Diatomite (Roughening Agent) |

The tips 236 in the second closure element 220 are preferably formed with a different polymeric raw second material which preferably includes a slip agent and which may be introduced into another reservoir which may feed this second material to a transfer channel and a slot combining region (both not shown but well known) so as to coextrude the tips 236 with the remaining main layer of the second closure element:

| MATERIAL | % | MI | DEN | TYPE |
|---|---|---|---|---|
| Blue Tips | | | | |
| Westlake 412AA | 46.0 | 2.0 | .922 | LD |
| Exxon 722.62 | 10.0 | 2.0 | .95 | EVA |
| Quantum 10533 | 4.0 | — | — | Slip |
| Quantum 35053 | 40.0 | — | — | Blue Color |

The transparent web regions and stalks of the first closure element 218 may be as follows:

| | MATERIAL | % | MI | DEN | TYPE |
|---|---|---|---|---|---|
| Clear | Rexene 1205C | 100 | 2.0 | .927 | Fully Formulated |

The following gram weights per foot are preferred in the formation of quart and gallon container bags and sandwich bags:

| | QT. & GAL. | SANDWICH |
|---|---|---|
| Main Layer | 3.9 | 3.3 |
| Blue Tips | .1 | .1 |
| Clear | .4 | .4 |
| TOTAL | 4.4 gm/ft | 3.8 gm/ft |

The feature of removing the slip agent from the webs 228,230 prevents bloom of this primary amide onto the web surfaces. By forming the main or web layer extrusion material with a roughening agent, this results in roughening of the web surfaces to create a writing surface by allowing better adhesion of ballpoint pen ink to the web surface. Preferred roughening agents, by way of example, are talc, diatomite, or other mineral fillers which increases writability by roughening the writing surface and which helps prevent smearing or rubbing off of ballpoint pen ink.

In addition, the gripping ridges 260,262 in webs 228,230 are of a greater distance from the closure elements 226,224 than is typical of profiles for reclosable bags. This spacing provides areas **230*b*,230*a* which are sufficiently large enough to permit information to be written thereon. Further, the spacing of the gripping ridges 260,262 provides generally flat writing surfaces 230*b*,230*a***, adding to the ease of writing thereon.

Further, the preferred gauge of the writable webs 228,230 is 3.5 mil or more. At this gauge, there is more structure or web body to write on.

Advantageously, in accordance with another feature of the invention, since the profile is multi-layer, the slip agent can still be added in vital areas to aid in the closing and opening of the profile. In the preferred embodiment, these vital areas comprise at least one of the tips in one set of the first or second hook-like projections, i.e., tips 236 in the second closure element 220 in the preferred embodiment.

In addition, it is to be noted that the addition of the slip and/or mineral fillers will not affect the functionality of the profile.

The feature of thoroughly mixing the roughening agent into the main or web layer extrusion material advantageously results in the simultaneous formation of roughened writing surfaces on both the inside and outside surfaces of each upper web portion **230*a*,230*b*, as well as the lower web portions 231**. There is no need to form the roughened writing surfaces as coextruded layers although it is within the scope of this invention to do so especially when a slip agent is used to form the tips of at least one set of hook-like locking projections.

It will be readily seen by one of ordinary skill in the art that the present invention fulfills all of the objections set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

What is claimed is:

1. A container comprising a pair of translucent or transparent side walls for defining a container interior and at least one open end; and a closure device including a first closure element and a second closure element each formed with a web respectively extending along said side walls adjacent said open end, said first and second elements being mateable so that, upon mating engagement of said first and second closure elements along their substantially entire respective lengths, said open end is substantially entirely closed, and wherein at least one of said first and second closure elements is colored a certain color so that upon substantially entirely complete mating of said first and second closure elements, said certain color is visually observable through an opposing one of said webs as a continuous band of said certain color, wherein the web carrying the first or second closure element of said certain color is opaque to provide contrast with said certain color when the first and second closure elements are viewed through the said opposing web, wherein at least one of the webs of said first and second closure elements is formed to include a particulate material which creates a roughened web surface allowing hand-written indicia medium to be formed on said surface by the consumer to identify the container contents.

2. The container of claim 1, wherein only tip portions of said one of the first and second closure elements is colored said certain color and remaining portions of said one of the first or second closure elements connecting the tip portions to the associated web is also opaque, wherein material forming the tip portions of said certain color contains a slip agent adapted to lubricate said tip portions to facilitate deflecting engagement with the other of said closure elements.

3. The container of claim 2, wherein the tip portions of the other of said first and second closure elements are also opaque to provide contrast with the tip portions of said certain color.

4. The container of claim 3, wherein the portions of said other of the first or second closure element connecting the tips to the said opposing web are made of a transparent or clear resin coextruded with said tip portions.

5. A container comprising a pair of side walls for defining a container interior and at least one open end;

and a closure device including a first closure element and a second closure element each formed with a web respectively extending along said side walls adjacent said open end, said first and second elements being mateable so that, upon mating engagement of said first and second closure elements along their substantially entire respective lengths, said open end is substantially entirely closed, and wherein at least one of said first and second closure elements is colored a certain color so that upon substantially entirely complete mating of said first and second closure elements, said certain color is visually observable through an opposing one of said webs as a continuous band of said certain color, wherein portions of the other of said first or second closure element formed on said opposing one of said webs are made of a transparent or clear resin coextruded with other portions of other of the first or second closure element which are made of a resin different from said transparent or clear resin, wherein said resin different from said transparent or clear resin includes a particulate material to create a roughened writing surface in one of the web surfaces, and wherein the resin forming said certain color is located outside of said web having the roughened surface and includes a slip agent providing lubrication to portions of the closure element containing said certain color.

* * * * *